US006614415B2

(12) United States Patent
Mizutani et al.

(10) Patent No.: US 6,614,415 B2
(45) Date of Patent: Sep. 2, 2003

(54) DISPLAY APPARATUS HAVING A LIQUID CRYSTAL DEVICE WITH SEPARATED FIRST AND SECOND THIN FILM TRANSISTORS

(75) Inventors: Hidemasa Mizutani, Sagamihara (JP); Yoshihiro Onitsuka, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/093,379

(22) Filed: Mar. 11, 2002

(65) Prior Publication Data

US 2002/0093480 A1 Jul. 18, 2002

Related U.S. Application Data

(62) Division of application No. 09/434,297, filed on Nov. 5, 1999, now Pat. No. 6,392,620.

(30) Foreign Application Priority Data

Nov. 6, 1998 (JP) ..... 10-316582

(51) Int. Cl.[7] ..... G09G 3/36
(52) U.S. Cl. ..... 345/90; 345/92
(58) Field of Search ..... 345/84, 87, 94, 345/97, 89, 92, 90, 91, 96; 349/41, 42, 46, 45, 47

(56) References Cited

U.S. PATENT DOCUMENTS 4,834,510 A * 5/1989 Fujita ..... 345/97
4,927,243 A 5/1990 Taniguchi et al. ..... 350/350 S
4,952,032 A 8/1990 Inoue et al. ..... 350/350 S
5,192,945 A 3/1993 Kusada ..... 345/103
5,748,164 A * 5/1998 Handschy et al. ..... 345/84
5,777,593 A * 7/1998 Kondoh ..... 245/89
6,064,362 A * 5/2000 Brownlow et al. ..... 345/205
6,115,015 A 9/2000 Fujita et al. ..... 345/88
6,151,004 A 11/2000 Kaneko ..... 345/88

FOREIGN PATENT DOCUMENTS

JP 8-95526 4/1996

* cited by examiner

*Primary Examiner*—Chanh Nguyen
(74) *Attorney, Agent, or Firm*—Fitzpatrick, Cella, Harper & Scinto

(57) ABSTRACT

A display apparatus features an optical modulation device including a plurality of pixels and a pair of electrodes to which a voltage is applied, and an illumination device for illuminating the optical modulation device instantaneously and successively with a plurality of monochromatic lights of different colors in a frame period to provide a full-color image in combination with application of the voltage to the electrodes of the optical modulation device thereby effecting a full-color display over a succession of the prescribed period. A controller divides each frame period into two periods including a first period for displaying a full-color image at each pixel and a second period immediately after the first period and for placing the optical modulation device in a non-display state, thus effectively suppressing an after image phenomenon adversely affecting a full-color image display in a subsequent frame period.

4 Claims, 11 Drawing Sheets

DISPLAY APPARATUS HAVING A LIQUID CRYSTAL DEVICE WITH SEPARATED FIRST AND SECOND THIN FILM TRANSISTORS

This is a divisional application of application Ser. No. 09/434,297, filed on Nov. 5, 1999, now U.S. Pat. No. 6,392,620.

FIELD OF THE INVENTION AND RELATED ART

The present invention relates to a display apparatus wherein three primary color images are successively or sequentially displayed in a short period of time and recognized as a full-color image by an observer.

As a display apparatus, a liquid crystal apparatus has been used in various equipment, such as personal computers, and in recent years, the liquid crystal apparatus has been desired to be adapted for color display.

As one scheme for effecting color display, as shown in FIG. 4, a scheme wherein one frame period (F1, F2, . . . ) is equally divided into three periods in which three color images of red (R), green (G) and blue (B) are successively displayed in a short period of time (i.e., in each of the three periods), respectively, and the resultant color images are memorized in human eyes as an afterimage, thus causing the observer to recognize the afterimage as a full-color image for each frame period (hereinafter, referred to as "three primary color sequential display scheme") has been proposed.

According to this scheme, the resultant liquid crystal apparatus has the advantages of an increase in apparent resolution by about three times an ordinary liquid crystal apparatus using color filters, a reduction in production costs since the apparatus is not required to use color filters and an increase in an aperture (opening) ratio by about three times the ordinary liquid crystal apparatus to lower a power consumption.

However, in such a liquid crystal apparatus according to a three primary color sequential display scheme, any one of the color images (R, G, B) is always displayed. As a result, in the case of motion (moving) picture display, image qualities of a full-color image recognized in a frame period F1 just before the frame period F2, i.e., deteriorated by the influence of an afterimage phenomenon such that the color images of R, G and B in the preceding frame period F1 are left as an afterimage still in the frame period F2.

More specifically, referring to FIG. 4, the last color image (B) in the frame period F1 is liable to overlap with the first color image (R) in the subsequent frame period F2, thus failing to obtain a desired hue in the frame period F2 (color drift or shift). Further, in the case where a color of a prescribed color value (e.g., white) is displayed based on the three color images (R, G, B) in the frame period F1 and another color of a different color value (e.g., black) is displayed based on those in the subsequent frame period F2, a desired color value is not obtained in the frame period F2 in some cases, thus resulting in gray display state under the influence of the white color image in the preceding frame period F1 (image blur).

SUMMARY OF THE INVENTION

An object of the present invention is to provide a display apparatus capable of preventing deterioration in image qualities even in the case of motion picture color display.

According to the present invention, there is provided a display apparatus, comprising:

- an optical modulation device including a plurality of pixels and a pair of electrodes to which a voltage is applied,
- an illumination device for illuminating the optical modulation device instantaneously and successively with a plurality of monochromatic lights of different colors in a prescribed period to provide a full-color image in combination with application of the voltage to the electrodes of the optical modulation device thereby effecting a full-color display over a succession of the prescribed period, and
- control means for dividing each prescribed period into two periods including a first period for displaying a full-color image at each pixel and a second period immediately after the first period and for placing the optical modulation device in a non-display state.

Herein, the term "instantaneously" means a sufficient short period of time to the extent that an observer visually recognizes the color light illumination state as a state such that the color lights are apparently continuously turned on and are not recognized as a succession of a lighting-on state and a lighting-off state.

This and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, preferred embodiments of the display apparatus of the present invention will be described with reference to the drawings.

Figure 1:
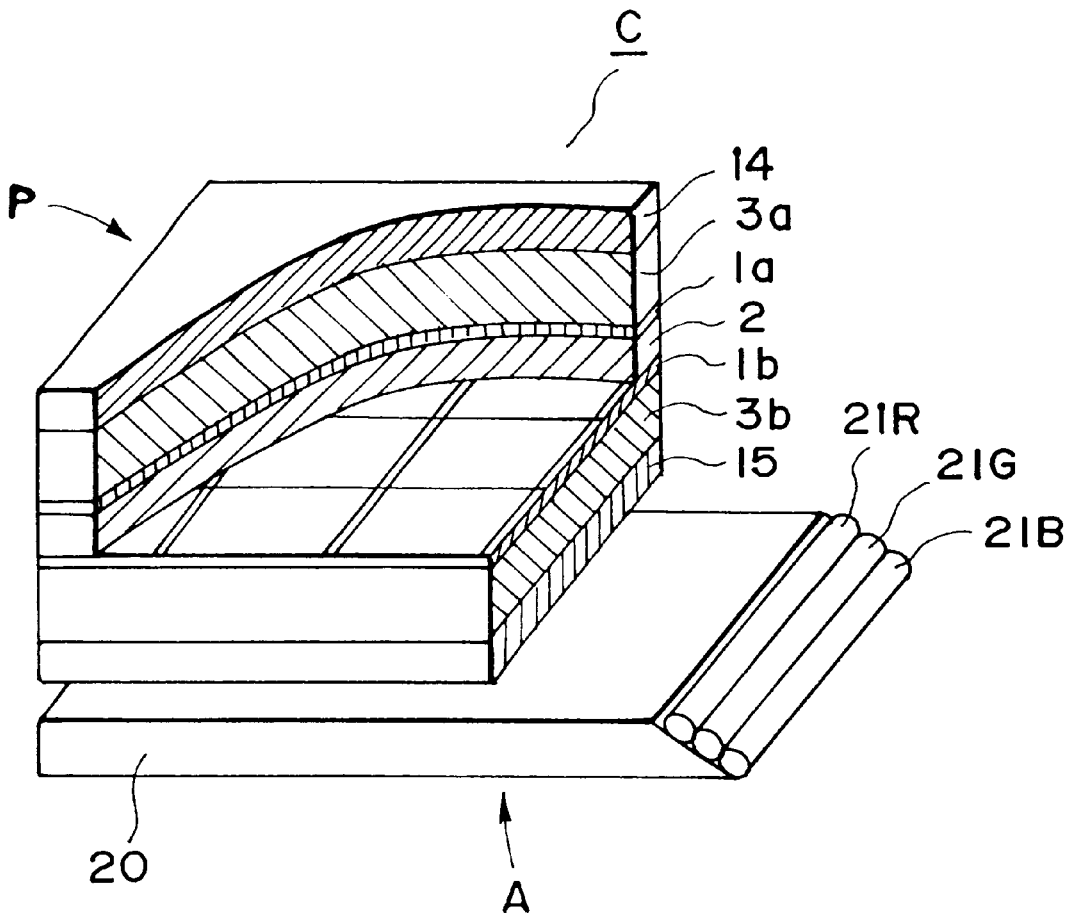
FIG. 1 is a schematic perspective view showing an embodiment of the display apparatus according to the present invention.

FIG. 1 shows an embodiment of the display apparatus according to the present invention.

Referring to FIG. 1, a liquid crystal apparatus (display apparatus) C includes a liquid crystal device (optical modulation device) P and an illumination device (backlight unit) A.

The liquid crystal device P includes a pair of substrates 3*a* and 3*b*, electrodes 1*a* and 1*b* disposed on the substrates 3*a* and 3*b*, respectively, and a liquid crystal 2 disposed between the electrodes 1*a* and 1*b*.

The liquid crystal device P may be of an active matrix-type or of a simple matrix-type.

In the latter case, the electrodes 1*a* and 1*b* each comprises a plurality of stripe-shaped electrodes arranged in a matrix form.

In the case of the active matrix-type liquid crystal device, the electrodes 1*a* correspond to a common (counter) electrode and the electrodes 1*b* correspond to a plurality of pixel electrodes disposed on the substrate 3*b* for each pixel together with a TFT (thin film transistor) 5 for sequential storage, a TFT 6 for simultaneous transfer, and a capacitor 7 for sample holding.

Outside the substrates 3*a* and 3*b*, a pair of polarizers 14 and 15 are disposed.

Outside the liquid crystal device P, the illumination device A is disposed.

The liquid crystal device P is driven by applying a voltage between the electrodes 1*a* and 1*b*, thus placing the liquid crystal 2 in a prescribed orientation (alignment) state providing a prescribed transmittance depending on the applied voltage and a V-T characteristic of the liquid crystal 2.

The illumination device A includes a light guide member 20 and a plurality of color light sources 21R for red (R), 21G for green (G) and 21B for blue (B).

The color light sources 21R, 21G and 21B are turned on or actuated so that monochromatic lights of different colors are successively emitted to the liquid crystal device P based on a prescribed timing signal.

Figure 3A:
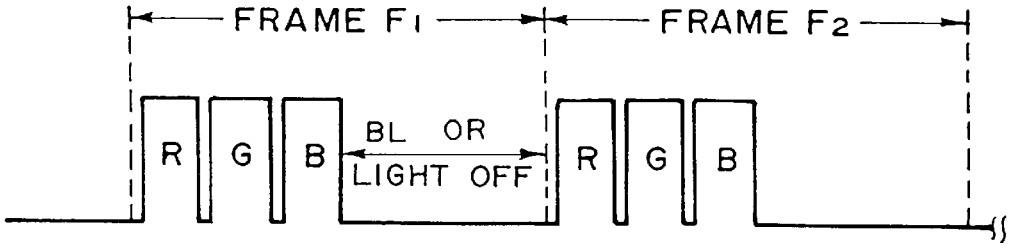
FIGS. 3A and 3B are respectively a time chart for illustrating an embodiment of color image display by the display apparatus of the present invention.

Respective color images for R, G and B are successively displayed in a short period of time (e.g., within half of one frame period F1 or F2) as shown in FIG. 3A by effecting drive of the liquid crystal device P so that an orientation (alignment) state of liquid crystal molecules is changed depending on the respective monochromatic lights in combination with lighting of or light emission from the monochromatic light sources 21R, 21G and 21B, respectively. As a result, the liquid crystal apparatus C causes an observer (viewer) to visually recognize the resultant image as a full-color image by utilizing the afterimages of the respective color images (R, G, B) memorized in human eyes (according to the above-mentioned three primary color sequential display scheme).

In the case where a plurality of full-color images are successively recognized by the observer, the liquid crystal apparatus includes control means for effecting a plurality of displaying operations including a full-color display operation and a non-display operation in each frame period (F1 or F2 as shown in FIG. 3A).

Figure 3B:
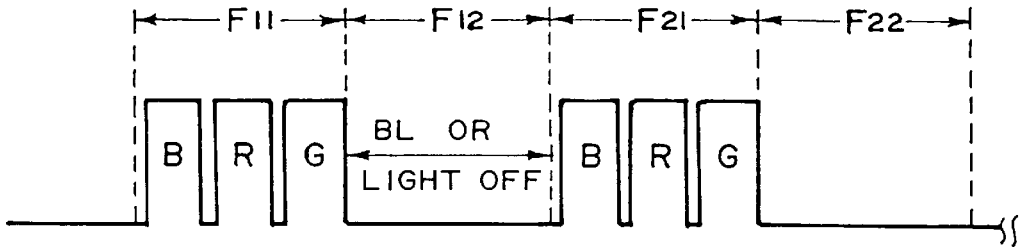
Figure 4:
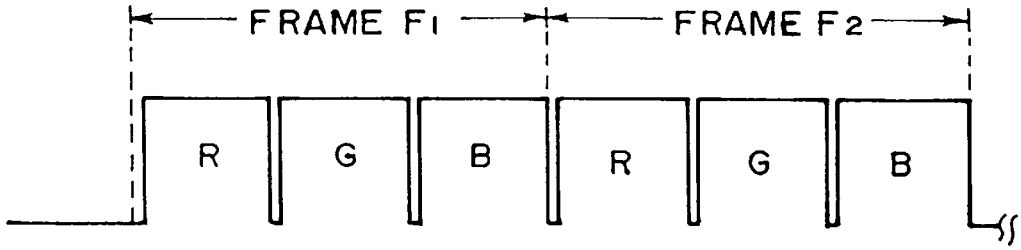
FIG. 4 PRIOR ART
FIG. 4 is a time chart for illustrating an embodiment of color image display by the conventional display apparatus.

Each frame period F1 (or F2) includes a full-color display period F11 (or F12) and a non-display state period F12 (or F22), and the non-display state period F12 is set between the adjacent two full-color display periods F11 and F21 (i.e., after the full-color display period F11) as shown in FIGS. 3A and 3B.

The non-display period F12 (or F22) may be set before the full-color display period F11 (or F21) or both before and after the display period F12 (or F21) within each frame period F1 (or F2).

In the case where one frame period (e.g., F1) includes a lighting-off (non-display) period wherein no color image is displayed by turning an associated light source off (e.g., a period between R-color display period and G-color display period), and non-display state period (e.g., F12) may preferably be set to be longer than the lighting-off period within the full-color display period (e.g., F11).

Herein, the term "non-display state period" (F12, F22, . . . ) refers to a period wherein no color images (full-color images) except for black image are displayed on the optical modulation device and visually recognized by the observer due to substantially zero-transmittance (transmitted light quantity) state or lighting-off state.

In order for the observer not to recognize any color image (except for black image), the liquid crystal device P may be driven so as to effect black image display irrespective of whether the illumination device A is turned on or off. Further, it is also possible to turn the illumination device A off (i.e., terminate the light emission from the illumination device A) irrespective of an image display state of the liquid crystal device P. For example, even when a prescribed color image is displayed on the liquid crystal device P, the non-display operation is ensured so long as the prescribed color image is not visually recognized (by human eyes).

The non-display state period (F12, F22, . . . ) may have a length (duration) such that the influence of the full-color image displayed in the full-color display period F11 is not left in the subsequent full-color display period F21. More specifically, the length of the non-display state period (F12, F22, . . . ) may be substantially half of one frame period (F1, F2, . . . ) as shown in FIGS. 3A and 3B or about ⅓ of one frame period. In the present invention, the length of the non-display state may preferably be set to be substantially at least ½ (half) of one frame period.

In the case where displayed images include a green (G) image, the green image may desirably be displayed last in each full-color display period (F11, F21, . . . ), i.e., display immediately before the non-display state period (F12, F22, . . . ) as shown in FIG. 3B in view of color-mixing problem described hereinafter.

In the liquid crystal apparatus according to the present invention, the monochromatic lights emitted from the illumination device A may preferably be lights of three primary colors (i.e., R-light, G-light and B-light), thus displaying full-color images based on R-image, G-image and B-image.

The illumination device A may be of any system so long as it can emit successively or sequentially monochromatic lights of different colors as mentioned above.

More specifically, the illumination device A may be a system including a plurality of (color) light sources (e.g., cold cathode tubes) 21R, 21G and 21B for emitting R-light, G-light and B-light, respectively, and being turned on instantaneously and successively as shown in FIG. 1 or may be a system including a light source for emitting white light, a dichroic mirror for successively color-separating the white light into respective primary color lights (R, G, B), and color filters for the respective primary color lights.

According to the above-described embodiment, in the case where plural color images are successively recognized by the observer, the adverse influence of the previously displayed image (e.g., an afterimage phenomenon such that a last color image in a frame period F1 still remains in a subsequent frame period F2 as an afterimage) is effectively averted or lessened by setting a non-display state period F12 between a full-color display period F11 and a subsequent full-color display period F21 as shown in FIGS. 3A and 3B. As a result, it is possible to improve image qualities even in the case of motion picture display while suppressing occurrence of color drift and/or image blur.

When cold cathode tubes are used as light sources 21R, 21G and 21B of the illumination device A, the G-light emitted from the light source 21G is liable to remarkably cause afterlight or afterglow compared with the cases of the R-light and the B-light. In that case, even when the voltage applied to the cold cathode tube (for G) 21G is removed, it takes a certain time to completely attenuate the resultant afterlight of the G-light. Accordingly, when a monochromatic light other than the G-light is emitted immediately after the cold cathode tube 21G is turned off, the resultant image is accompanied with a color-mixing problem with the G-color. In this case, however, as mentioned above, the G-color image is displayed immediately before the above-mentioned non-display state period (F12, F22, . . . as shown in FIG. 3B), thus obviating such a color-mixing problem.

Further, the adverse influence of the afterlight in the illumination device A can be averted by effecting the black image display in the non-display state period by the liquid crystal device P as described above.

When the illumination device A is turned off in the non-display state period, it is possible to reduce a power consumption.

EXAMPLE

Hereinbelow, the present invention will be described more specifically based on Example with reference to the drawings.

Figure 2:
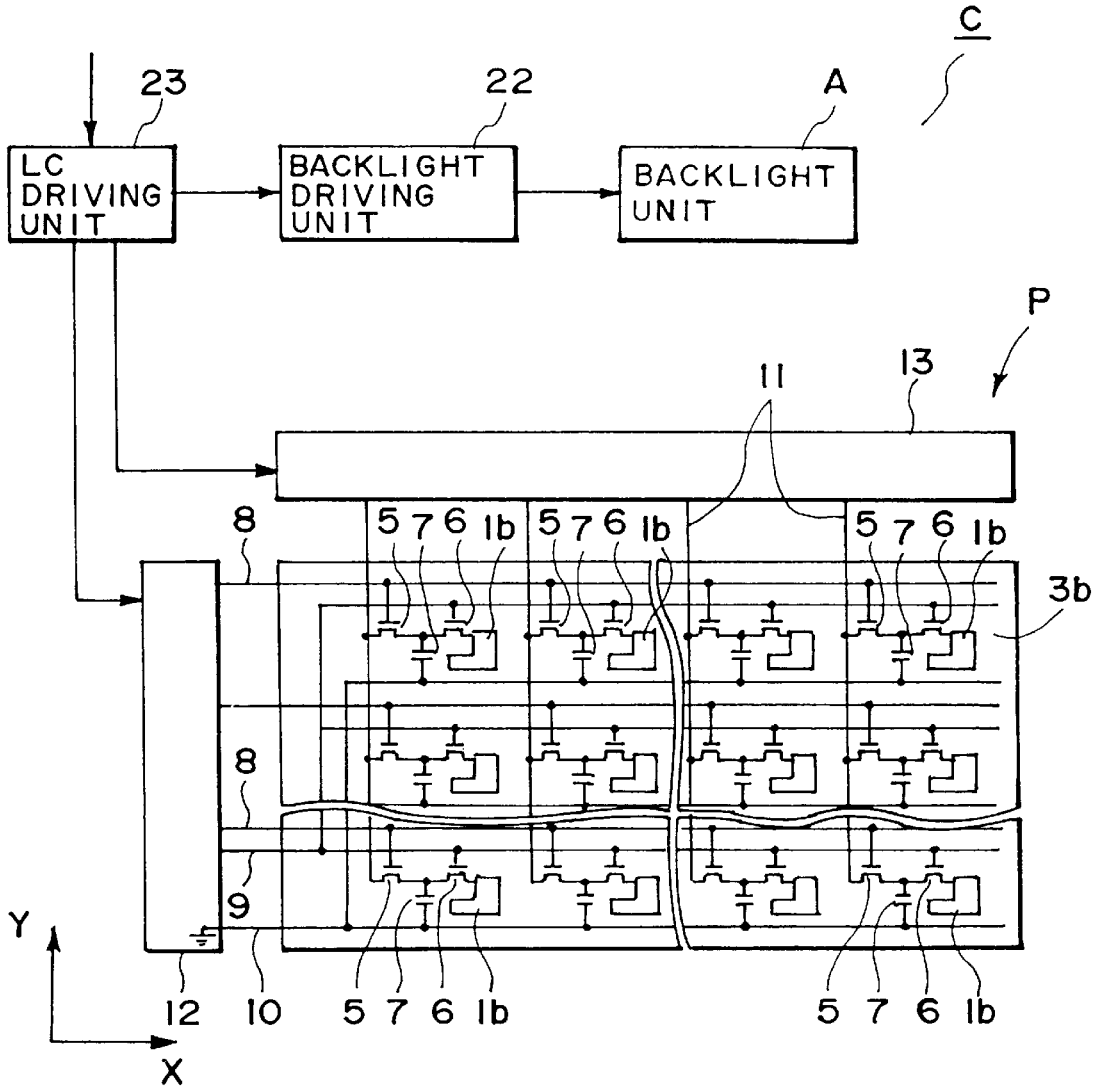
FIG. 2 is a circuit diagram for illustrating an embodiment of a structure of the display apparatus of the present invention.

In this example, a liquid crystal apparatus C including an active matrix-type liquid crystal panel (device) P and an illumination device A as shown in FIGS. 1 and 2 was prepared in the following manner.

Referring to FIG. 1, the liquid crystal panel P was formed in 17 in.-size and provided with 1280×1024 pixels (SXGA mode).

The liquid crystal panel P included a pair of glass substrates (upper and lower substrates) 3*a* and 3*b* disposed opposite and parallel to each other with a prescribed spacing therebetween.

At the surface of the lower substrate 3*b*, as shown in FIG. 2, a plurality of pixels were arranged in matrix form. Each pixel was provided with a TFT 5 for successive (sequential) storage, a TFT 6 for whole transfer, a capacitor 7 for sample holding, and a pixel electrode 1*b*.

As shown in FIG. 2, a plurality of gate lines 8, a whole-writing line 9 and an earth line 10 were connected with respective lines of the associated pixels in a direction of X and a plurality of source lines (data lines) 11 were connected with respective lines of the associated pixels in a direction of Y. More specifically, gates of the (successive-storage) TFT 5 along the same gate line 8 in the X-direction were connected with the associate (same) gate line 8. Sources of the TFT 5 along the same source line 11 in the Y-direction were connected with the associated source line 11. Each of drains of the TFT 5 was connected with one terminal of an associated capacitor 7 and a source of the associated (whole-transfer) TFT 6. The other terminal of each capacitor 7 was connected with the earth line 10. Gates of the TFT 6 were together connected with the whole-writing line 9 and drains of the TFT 6 were connected with the associated pixel electrodes 1*b*, respectively.

On the lower substrate 3*b*, an alignment film (not shown) was disposed so as to cover the TFTs 5 and 6 and the pixel electrodes 1*b*.

On the other hand, a common (counter) electrode 1*a* was disposed on the upper substrate 3*a*. On the common electrode 1*a*, an alignment film (not shown) was disposed so as to cover the common electrode 1*a*.

In the spacing between the upper and lower substrates 3*a* and 3*b* thus prepared, the liquid crystal 2 comprising a ferroelectric liquid crystal was filled and sealed up with a sealing agent (not shown).

Referring again to FIG. 2, a row driver 12 for supplying signals to the gate lines 8, the whole-writing line 9 and the earth line 10 and a column driver 13 for supplying signals to the source lines 11 were disposed along sides extending in the Y-direction and X-direction, respectively, of the liquid crystal panel P.

To the row driver 12, the gate lines 8, the whole-writing line 9 and the earth line 10 were connected and, the earth line 1 was grounded within the row driver 12. The ground (earth) voltage at that time was a reference voltage for image (picture) signals applied to the data lines 11 and was equal to a voltage applied to the common (counter) electrode 1*a*.

To the column driver 13, the source lines (data lines) 11 were connected.

To the common electrode 1*a*, a prescribed voltage (i.e., the reference voltage applied to the data lines 11) was applied.

At both sides of the liquid crystal panel P (i.e., outsides of the pair of substrates 3*a* and 3*b*), a pair of polarizers 14 and 15 was disposed so that their transmission axes intersected each other substantially at right angles and one of the transmission axes of the polarizers 14 and 15 was substantially in parallel with one of liquid crystal molecular axes providing two optically stable states of the ferroelectric liquid crystal 2.

As a result, when liquid crystal molecules are placed in a first stable state, the liquid crystal panel P provides the brightest display state. On the other hand, when the liquid crystal molecules are placed in a second (the other) stable state, the liquid crystal panel P provides the darkest display state, thus allowing a light switching operation.

As the illumination device A, a backlight unit was disposed behind the liquid crystal panel P as shown in FIG. 1.

The backlight unit A was comprised of a transparent light-guide member 20 disposed along the planar surface of the liquid crystal panel P and three cold cathode tubes 21R, 21G and 21B emitting R-light, G-light and B-light, respectively, together disposed on one side of the light-guide member 20. These cold cathode tubes 21R, 21G and 21B were controlled by a backlight driving unit 22 (FIG. 2).

Incidentally, each of the above-mentioned alignment films was comprised of an organic polymeric compound (polyimide in this example) and was subjected to a rubbing (uniaxial aligning) treatment.

The thus prepared liquid crystal panel was driven in the following manner.

When the liquid crystal apparatus was actuated, as shown in FIG. 2, image signals were transmitted to a liquid crystal driving unit 23 and divided into three picture (gradation) signals for R-image, G-image and B-images and a synchronizing signal. The respective picture signals were transmitted to the column driver 13 in accordance with the synchronizing signal. The synchronizing signal was sent to the row driver 12 and the column driver 13.

(1) Display of R-Image on the Liquid Crystal Panel P (1-1) Writing of Picture Signal for R-Image into Respective Capacitors 7

Figure 5:
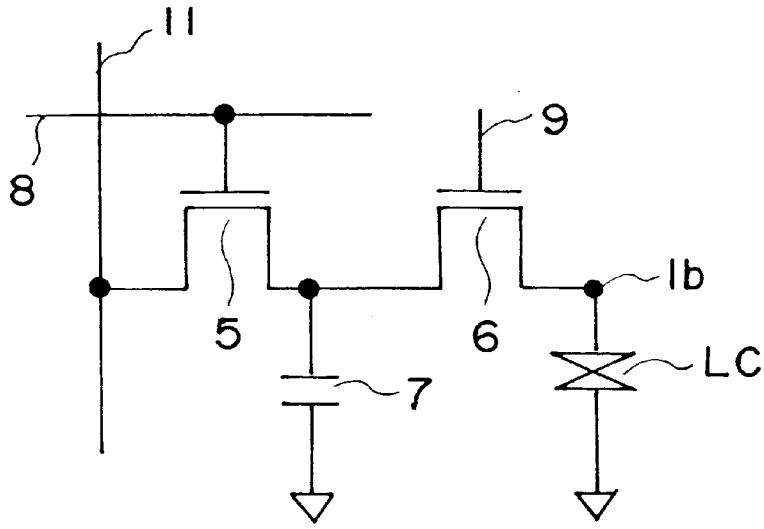
FIG. 5 is an equivalent circuit diagram for illustrating one pixel portion of the optical modulation device used in the display apparatus of the present invention shown in FIG. 2.
Figure 6:
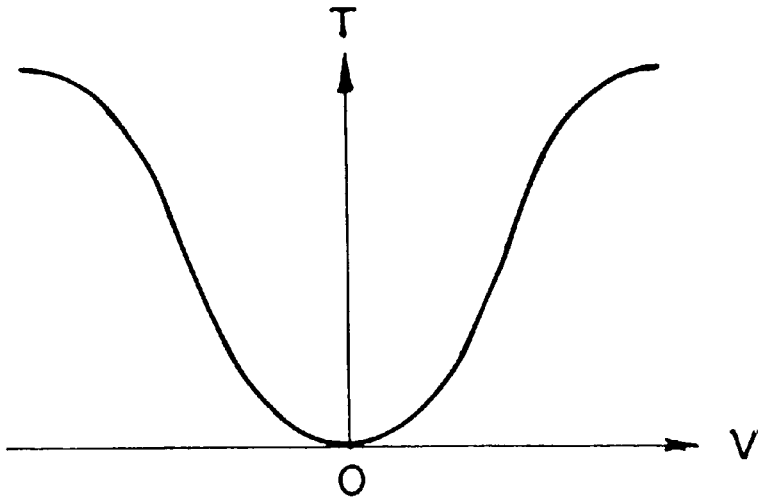
FIGS. 6, 11 and 12 are graphs each showing a relationship between a voltage and a transmittance (V-T characteristic) of a liquid crystal used in the display apparatus of the present invention, respectively.
Figure 7:
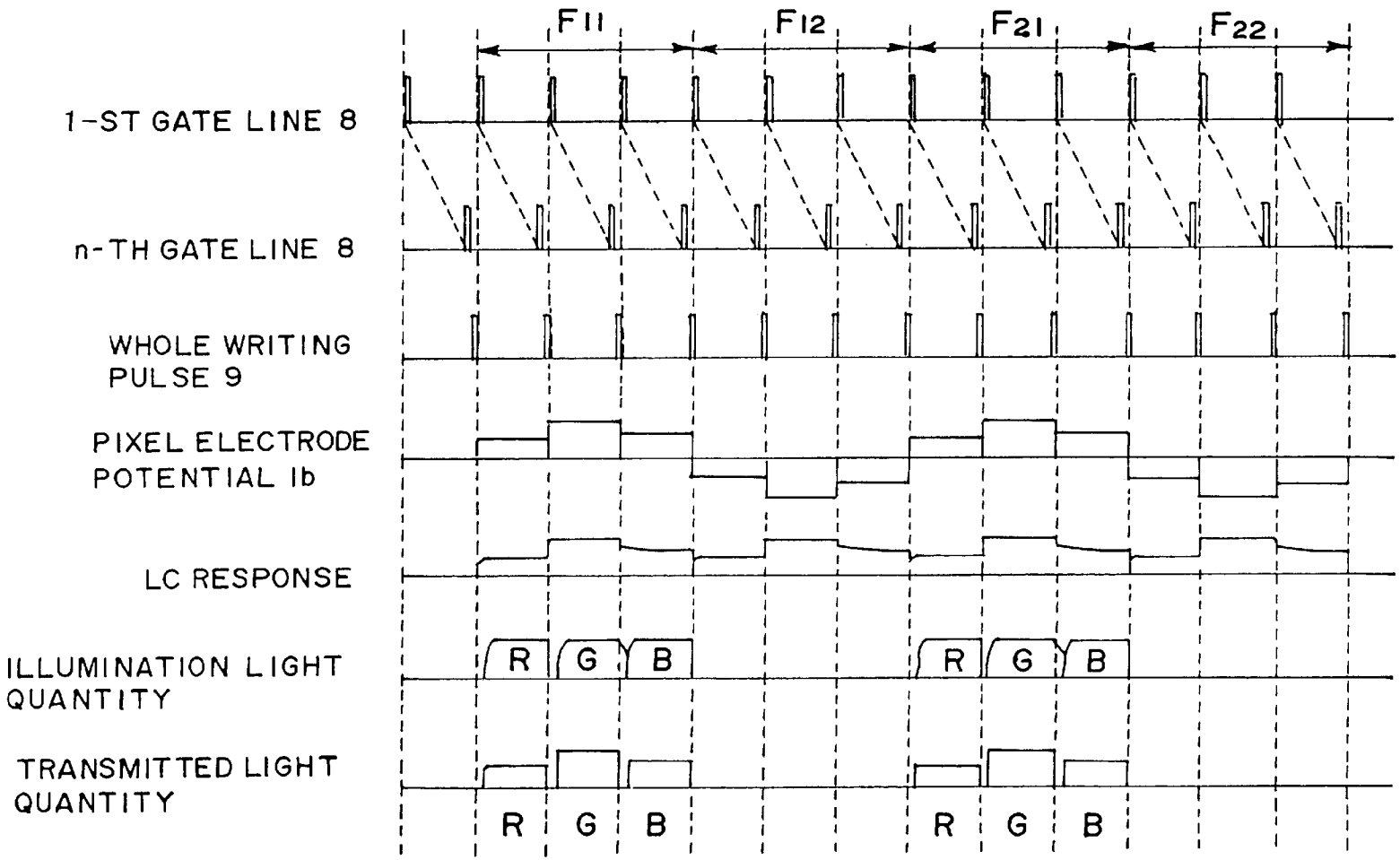
FIGS. 7, 9, 10 and 13 are time charts each for illustrating a driving sequence adopted in the display apparatus of the present invention, respectively.

With respect to this example, FIG. 5 shows an equivalent circuit at one pixel portion, FIG. 6 shows a voltage-transmittance (V-T) characteristic of the liquid crystal 2 used, and FIG. 7 shows time charts representing a driving sequence of the liquid crystal panel.

Referring to FIG. 7, the abscissa represents a time. The ordinate for a first gate line 8, n-th gate line 8, and whole-writing pulse 9 represents a voltage value. The ordinate for illumination light quantity was associated with the respective color lights (R, G, B) and that for transmitted light quantity was associated with the respective optical outputs.

Figure 9:
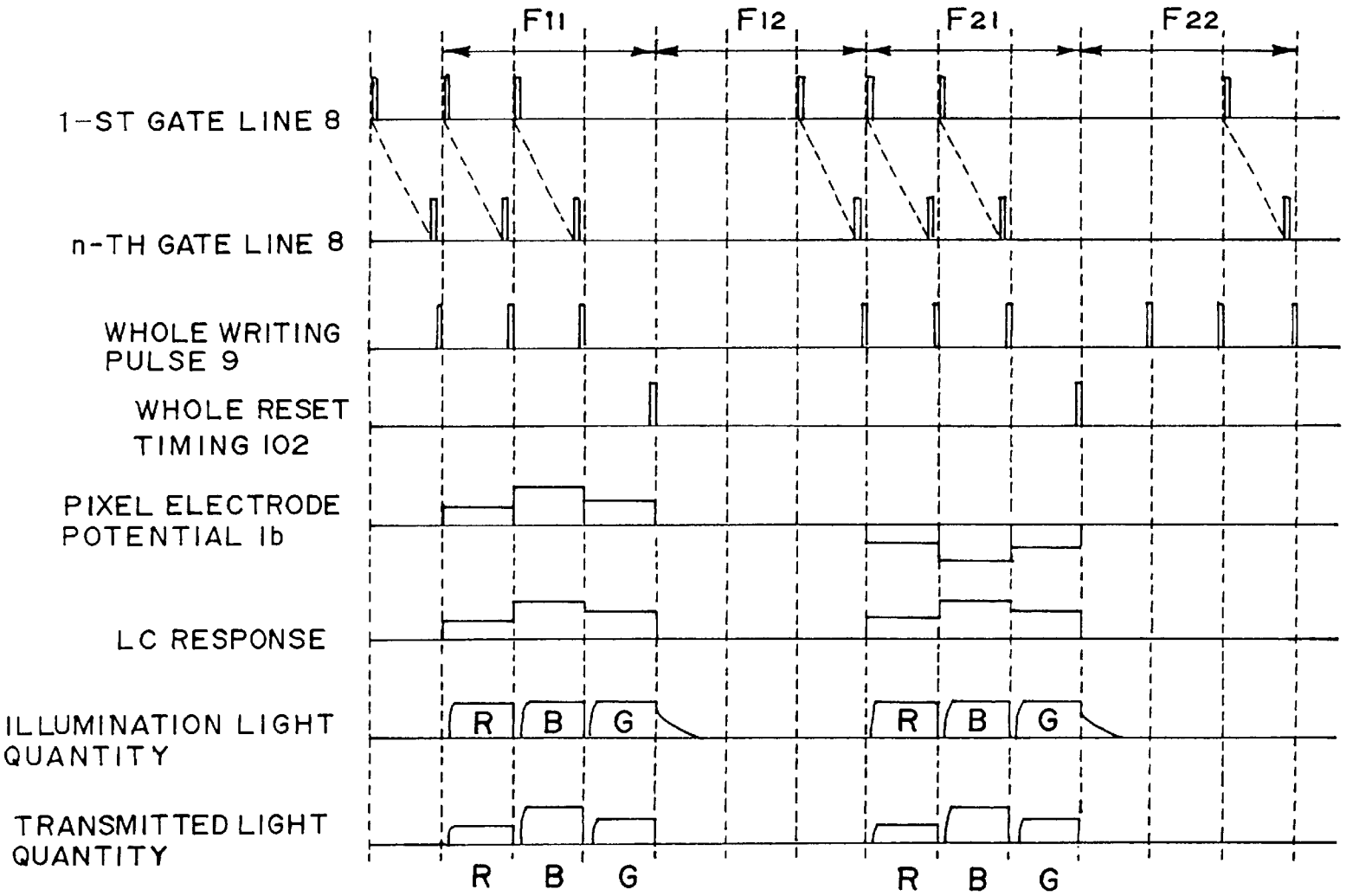
Figure 10:
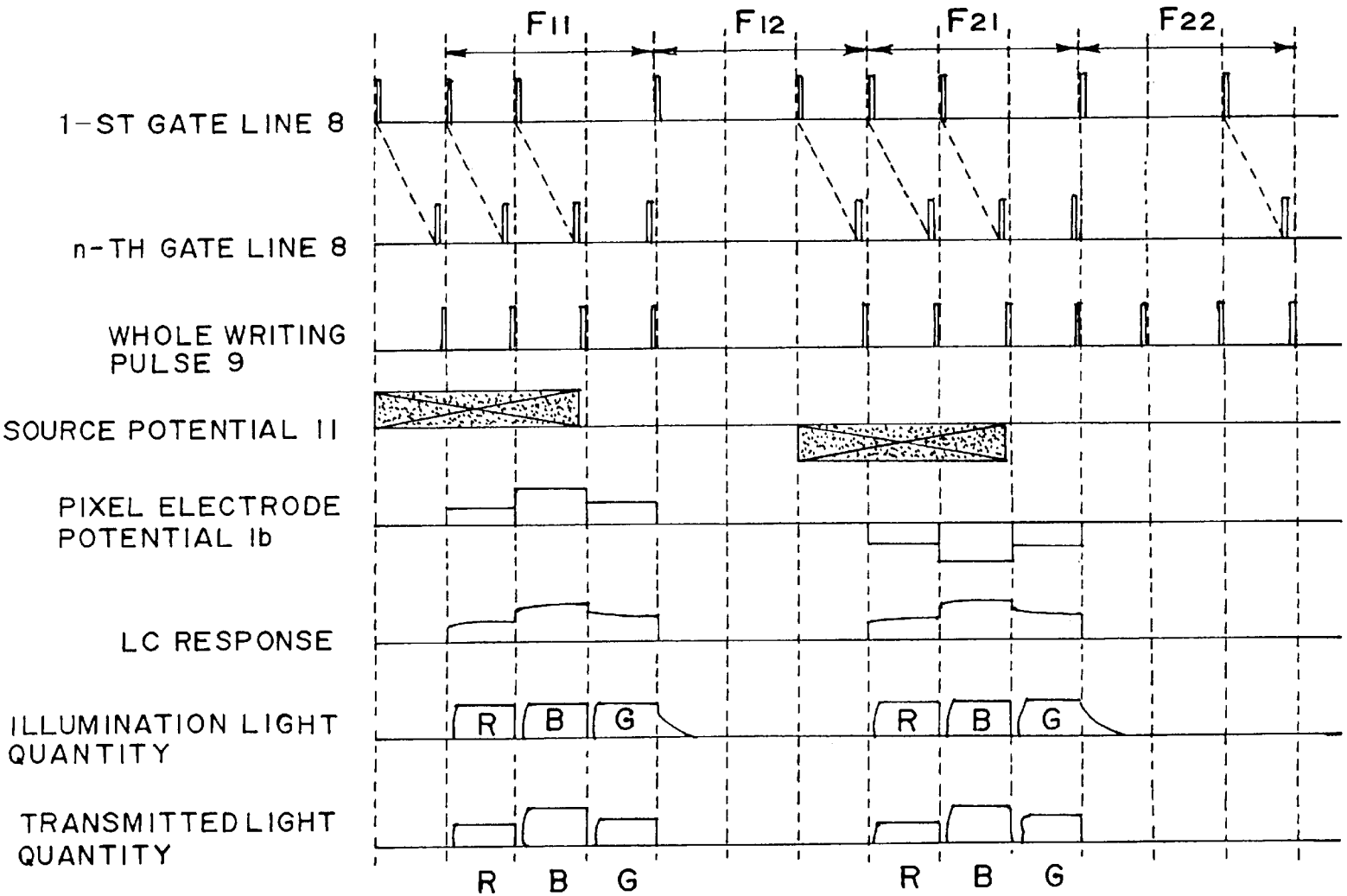
Figure 13:
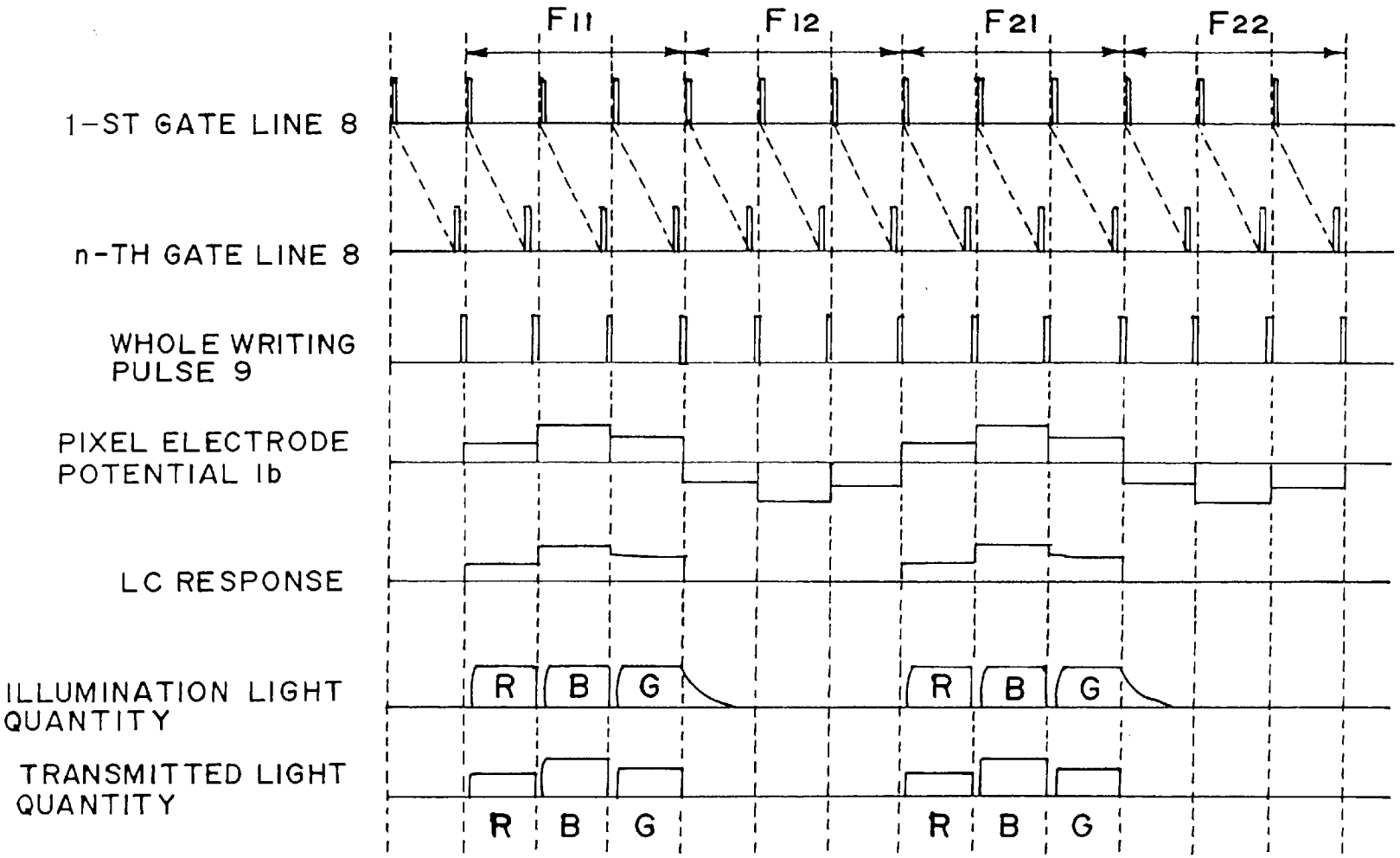

FIGS. 9, 10 and 13 shows time charts representing other driving sequences of the liquid crystal panel, respectively. In these figures, the abscissas and the ordinates represents corresponding those for FIG. 7. The abscissas for a whole-reset timing pulse 102 and a source potential 11 also represent a voltage value.

For driving operation, first, the row driver 12 supplies a gate pulse to a first gate line 8 on, and the column driver 13 supplies a prescribed voltage signal to the respective source lines (data lines) 11. As a result, the voltage signal is applied to the respective capacitors 7 via the associated TFTs 5, respectively, placed in "ON" state described above, thus being stored or accumulated in the capacitor 7.

The row driver 12 terminates the supply of the gate pulse after a lapse of a prescribed period of time to turn the TFTs 5 off but, the capacitors 7 hold the charged (stored) voltage also after the TFTs 5 are turned off.

In a similar manner, picture (image) signals are successively (sequentially) written in the associated capacitors along a second gate line 8 to the last gate line 8, respectively, by the row driver 12 and a column driver 13, thus effecting a sequential image writing operation (every row line).

In this example, the sequential image writing operation for the liquid crystal panel (1280 source lines and 1024 gate lines) was performed according to the driving sequence shown in FIG. 7 under conditions such that a frame frequency was set to 60 Hz, one frame period was equally divided into a full-color display period (F11 or F22) and a non-display state period (F12 or F22), and the full-color display period was equally divided into three field periods each for R-image display, G-image display and B-image display (i.e., one field period being ⅙ of one frame period). In non-display state period also corresponded to three field periods. In this case, a gate pulse application time was (1/60)/6/1024=2.7 μsec since all the gate lines 8 were successively selected (scanned) in one field period (for R, G or B).

(1-2) Writing of R-Image into the Liquid Crystal Panel P

After the sequential (picture) image writing operation to the capacitors 7 along all the gate lines 8 is completed, the row driver 12 supplies a rewriting pulse to the whole-writing line 9, thus turning the (whole-transfer) TFTs 6 along all the gate lines 8 on. As a result, the picture image signals held in the respective capacitors 7 were applied simultaneously (together in a lump) to the associated pixel electrodes 1*b* via the TFTs 6 thereby to change an orientation (alignment) state of liquid crystal molecules, thus providing a prescribed display image on the liquid crystal panel P.

In the above operation, although the driver 12 terminates the re-writing pulse application at the time the voltage of the pixel electrodes 1*b* is stabilized and then turns the (whole-transfer) TFTs 6 on, the picture image signals applied to the pixel electrodes 1*b* is still held after the TFTs 6 are turned off since the pixel electrodes 1*b* constitute a capacitor structure with the common electrode 1*a* while sandwiching the liquid crystals therebetween. Accordingly, the above prescribed display image is also maintained even after the TFTs 6 are turned off.

(1-3) Illumination of R-Light onto the Liquid Crystal Panel P

The above-mentioned re-writing pulse is also transmitted to the backlight driving unit 22 as a timing signal for determining a timing of lighting of the cold cathode tube 21R for R-light of the backlight unit A.

The backlight driving unit 22 actuates (drives) the backlight unit A so as to illuminate the liquid crystal panel P with R-light simultaneously with or after a lapse of a prescribed period of time from the receiving of the re-writing pulse. As a result, the display image on the liquid crystal panel is visually recognized as R-image by the observer (human eyes).

(2) Display of G-Image on the Liquid Crystal Panel P (2-1) Writing of Picture Signal for G-Image into Respective Capacitors 7

During the R-image display operation, in a similar manner as in the above (1-1), picture (image) signals for G-image are written in the respective capacitors 7.

(2-2) Writing of G-Image into the Liquid Crystal Panel P

In the same manner as in the case of R-image display (1-2), an image for G image is displayed on the liquid crystal panel P when the (whole-transfer) TFTs 6 are turned on.

(2-3) Illumination of G-Light onto the Liquid Crystal Panel P

Similarly as in the case of R-light (1-3), G-light is emitted from the cold cathode tube 21G for G-light of the backlight unit A to the liquid crystal panel P, whereby the displayed image on the liquid crystal panel P is visually recognized as G-image.

(3) Display of B-Image on the Liquid Crystal Panel P

In a similar manner as in the G-image display (2-1) to (2-3), B-image is displayed on the liquid crystal panel P.

(4) Recognition of Full-Color Image

As described in the display operations for R-, G- and B-images (1) to (3), three primary color images (R, G, B) are successively displayed in a very short time period (i.e., F11 or F21 in FIG. 3B), whereby the resultant images remain in human eyes as an afterimage. As a result, the remaining R-, G-, B-images are visually overlapped to be recognized as a desired full-color image in a frame period (e.g., F1 or F2 in FIG. 3A).

In this example, when the liquid crystal apparatus C including the liquid crystal panel P and the backlight unit (illumination device) A was driven in accordance with the above-described driving sequence shown in FIG. 7 and the above-described display operations for R-, G- and B-colors, a desired full-color image was effectively displayed with no color drift and no image blur by setting the non-display state period (e.g., F12 or F22 in FIG. 3B) in one frame period (F1 or F2 in FIG. 3A).

Incidentally, in this example, as shown in FIG. 7, the polarity of the pixel electrode potential applied to each pixel electrode 1*b* was changed (inverted) for each full-color display period (F11 or F21) or each non-display state period (F12 or F22) to counterbalance DC components applied to the liquid crystal 2, thus preventing a deterioration of a switching characteristic of liquid crystal molecules.

Further, in this example, in each non-display state period (e.g., F12 or F22 in FIG. 3B), the backlight unit A was placed in a "(light-)OFF" state.

As a modification of this example, irrespective of the state ("ON" or "OFF") of the backlight unit A, it is possible to display a black (BL) state on the liquid crystal panel in each non-display state period.

More specifically, when the liquid crystal 2 has a V-T characteristic as shown in FIG. 6, a black gradation signal may be applied to the liquid crystal panel P by applying a ground potential to the liquid crystal panel P.

Figure 8:
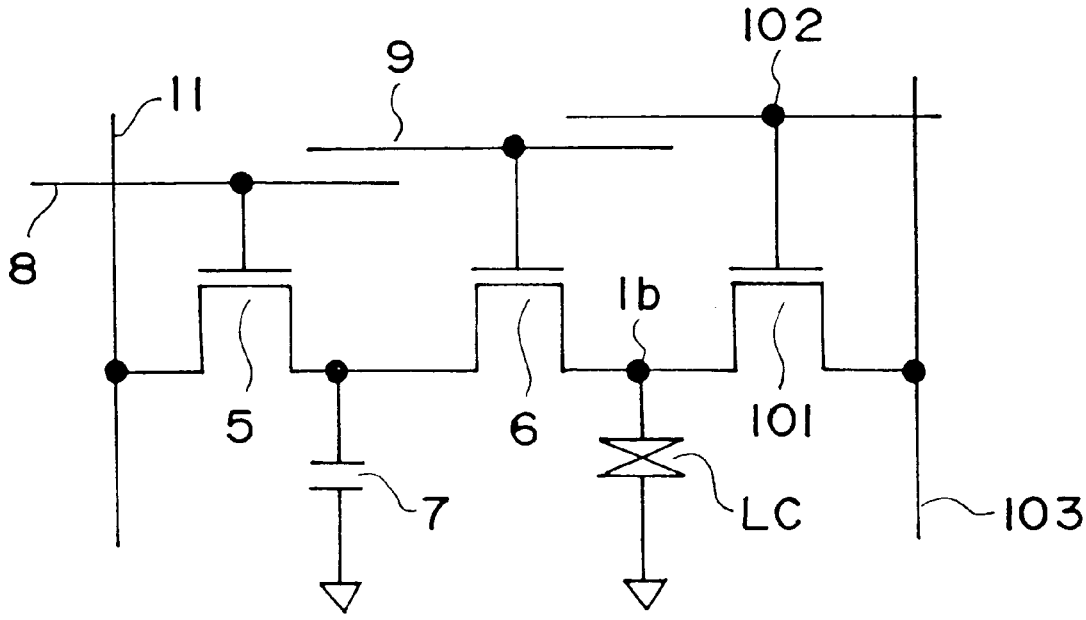
FIGS. 8 and 14 are other equivalent circuit diagrams each for illustrating one pixel portion of an optical modulation device used in the display apparatus of the present invention.

For example, when the liquid crystal panel P is driven by using an equivalent circuit (for each pixel portion) as shown in FIG. 8 and a driving sequence as shown in FIG. 9, each pixel is provided with a whole-reset TFTs 101 connected via a whole-reset line 102 with a control circuit (not shown) other than the drivers 12 and 13 and connected via a whole-reset source line 103 with a whole-reset power source (not shown) capable of setting an appopriate voltage depending on the liquid crystal 2 used. All the pixel electrodes 1*b* in this case are supplied with a black gradation signal (whole-reset timing pulse (as shown in Figure)) at the same time at the last portion in each thereto, thus resetting the voltages of the pixel electrodes 1*b* into the ground potential together in a lump to provide a black display state in the entire liquid crystal panel P.

It is also possible to provide the black display state by setting a source potential of all the source lines 11 in each non-display state period to be the ground potential by using a combination of the equivalent circuit as shown in FIG. 5 and a driving sequence as shown in FIG. 10.

Referring to FIGS. 5 and 10, a selection pulse is applied to 1st to n-th gate lines 8 and the whole-writing line 9 at the same time to turn the TFTs 5 and 6 on and in synchronism with the selection pulse application, a reference potential signal for placing the liquid crystal 2 in a state providing a black display state (non-recognizable display state) is applied to the source lines 11, thus resulting in the black display state in each non-display state period (F12 or F22).

Figure 11:
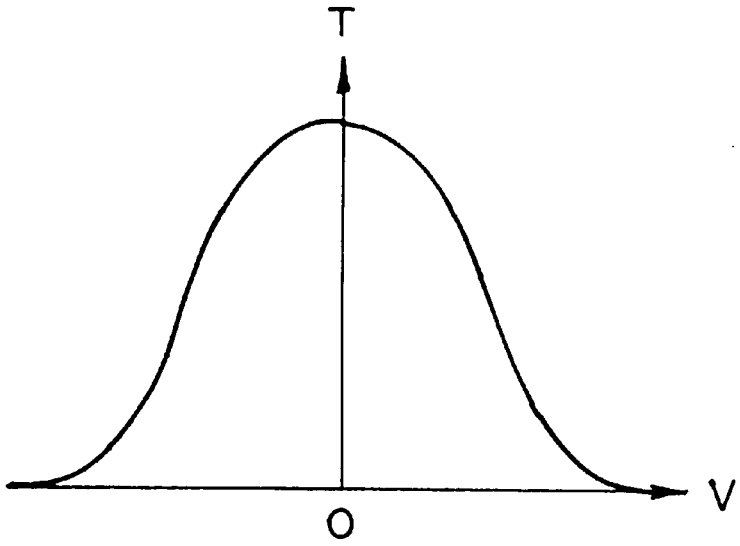

In the case of using a liquid crystal 2 having a V-T characteristic as shown in FIG. 11, in each non-display state period (F12 or F22), the liquid crystal panel P is supplied with a saturation voltage (Vsat) providing a transmittance (T) of substantially zero %.

Figure 12:
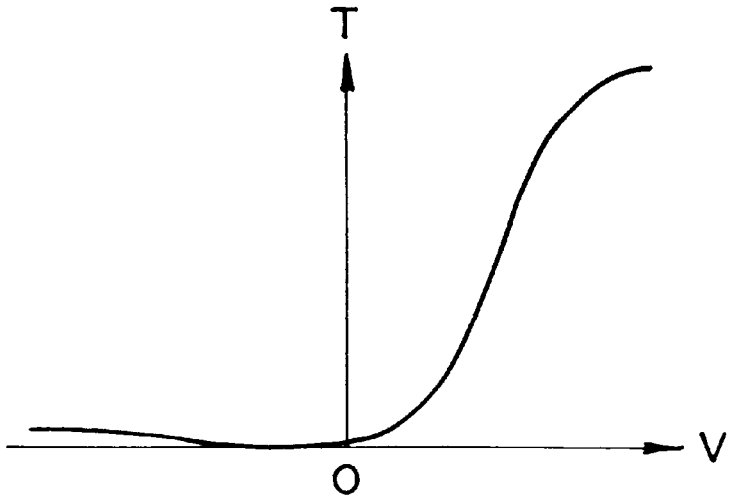

In the case of using a liquid crystal 2 having a V-T characteristic as shown in FIG. 12, as shown in a driving sequence as shown in FIG. 13, the liquid crystal panel P is supplied with a negative-polarity voltage providing a substantially zero transmittance in each non-display state period (F12 or F22).

Figure 14:
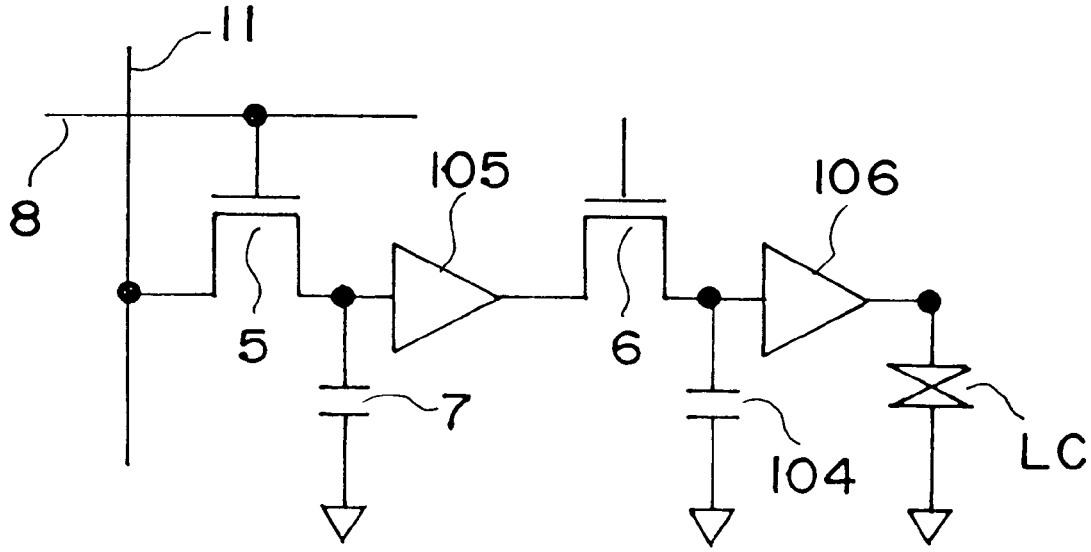

Further, in the case of using a liquid crystal 2 having a spontaneous polarization, it is possible to employ an equivalent circuit providing an amplifying structure as shown in FIG. 14 in combination with any one of the above-mentioned driving sequences as shown in FIGS. 7, 9, 10 and 13, in order to prevent a lowering in pixel electrode potential due to the response of the liquid crystal 2. In this case, as shown in FIG. 14, each pixel is further provided with a capacitor 104 for controlling a pixel electrode voltage, a buffer 105 for compensating a transfer voltage level and a buffer 106 for compensating an inersion current due to spontaneous polarization of the liquid crystal 2.

In the driving sequences shown in FIGS. 7, 9, 10 and 13, each non-display state period (F12 or F22) may preferably have a length which is at least ⅓ of the full-color display period (F11 or F21) in order to visually separate the images in adjacent frames close to each other.

Further, in FIGS. 7, 9, 10 and 13, the respective color display periods (R-display period, G-display period and B-display period) each having a length of ⅓ of F11 or F21 may have different lengths within an extent not adversely affecting the resultant full-color image.

According to the above-described example, by setting a non-display state period within each frame period, the adverse influence of the previously displayed image on the current display image is averted or minimized (e.g., the last color image displayed in a frame period F1 is not left in a subsequent frame period F2 as an afterimage). As a result, even in the case of motion picture display, it is possible to provide good image qualities while suppressing occurrences of color drift and image blur.

Further, writing of picture (image) signals (e.g., for G-color) into all the capacitors 7 is performed during the display of previous color (e.g., R-color) image and application of the picture signals onto all the pixel electrodes 1*b* is effected at the same time (together in a lump), so that the display period (field period) for each of the respective colors (R, G and B) is prolonged to improve the resultant luminance of the liquid crystal panel based on the prolonged display period.

In the above example, although a plurality of TFTs 5 and 6 are provided to each pixel together with a capacitor 7, these TFTs 5 and 6 and the capacitor 7 can be prepared in similar steps to those for the conventional TFT-type liquid crystal panel, thus not rendering the production process thereof so complicated.

In the above example, although the display apparatus according to the present invention is described as the liquid crystal display apparatus using the liquid crystal panel as the optical modulation device, it is possible to employ an (organic) EL (electroluminescent) device or a DMD (digital micromirror device) as the optical modulation device. The DMD is a display device for use in a projector and control ON/OFF of light by disposing a mechanically moving part on a semiconductor substrate.

In the present invention, the liquid crystal device (panel) may most suitably be used as the optical modulation device for the display apparatus since the above-mentioned advantageous effects of the present invention can be achieved effectively.

As described hereinabove, according to the present invention, when a plurality of full-color images are successively visually recognized by the observer, a full-color display period (e.g., F11 shown in FIG. 3B wherein three primary color images (R, G and B) are successively displayed) and a subsequent full-color display period (e.g., F21) are separated timewise by an intervening non-display state period (e.g., F12) for ensuring a period of time sufficient to suppress or minimize the adverse influence of the previously displayed full-color image on the subsequent full-color image. The setting of the non-display state period is also effective in displaying motion picture image thus ensuring good image qualities while suppressing the above-mentioned color drift and image blur phenomenon.

Further, when the G-image is displayed by using a cold cathode tube (e.g., 21G shown in FIG. 1) of the illumination device A, as in the above-mentioned driving sequences shown in FIGS. 9, 10 and 13, the G-image display operation with the cold cathode tube 21R is performed in the last field period of each full-color display period (F11 or F21) since the G-light emitted from the cold cathode tube 21G requires a certain attenuation period as shown in FIGS. 9, 10 and 13 until the G-light is completely attenuated as described hereinabove. By performing the G-image display operation after the other image display operations for the R-color and the B-color, the attenuation period of the G-image is terminated within each non-display state period, thus effectively obviating an undesirable color-mixing problem due to the attenuation period of the G-image.

What is claimed is:

1. A liquid crystal apparatus, comprising:

a liquid crystal device including a liquid crystal, a plurality of pixel electrodes for applying a voltage to said liquid crystal arranged in a matrix form, a plurality of first thin film transistors for simultaneous transfer connected to said pixel electrodes, a plurality of second thin film transistors for successive charge storage, a plurality of sample-and-hold circuits each connected to and disposed between a first thin film transistor and a second thin film transistor, a plurality of gate lines each connected to gates of associated second thin film transistors for successive charge storage along a same gate line, and a whole-writing line, different from said plurality of gate lines, connected to all of the gates of said first thin film transistors for simultaneous transfer;

a buffer disposed between one of said first thin film transistors and a pixel electrode or between one of said second thin film transistors and one of said first thin film transistors;

means for generating picture image signals for defining gradation images for three primary colors to be visually recognized and displayed on said liquid crystal device as a full-color image; and a light source for illuminating said liquid crystal device with a plurality of color lights corresponding to the gradation images displayed on said liquid crystal device in a three primary color sequential display scheme, wherein said liquid crystal has a spontaneous polarization.

2. An apparatus according to claim 1, further comprising control means for dividing frames into a first frame period for displaying a full-color image by applying a voltage of one polarity to said liquid crystal, and a second frame period for not displaying the full-color image by applying a voltage of the other polarity.

3. An apparatus according to claim 2, wherein said liquid crystal exhibits a voltage-transmittance characteristic of showing a transmittance increasing monotonously in response to the voltage of one polarity and a transmittance which is non-zero but is little changed in response to the voltage of the other polarity.

4. An apparatus according to claim 3, wherein in each frame, DC components applied to said liquid crystal are counterbalanced with each other.

* * * * *

UNITED STATES PATENT AND TRADEMARK OFFICE

CERTIFICATE OF CORRECTION

PATENT NO. : 6,614,415 B2
DATED : September 2, 2003
INVENTOR(S) : Hidemasa Mizutani et al.

It is certified that error appears in the above-identified patent and that said Letters Patent is hereby corrected as shown below:

Column 9,
Line 10, “appopriate” should read -- appropriate --.

Signed and Sealed this

Ninth Day of March, 2004

JON W. DUDAS
*Acting Director of the United States Patent and Trademark Office*